US010972844B1

(12) United States Patent
Chiang et al.

(10) Patent No.: US 10,972,844 B1
(45) Date of Patent: Apr. 6, 2021

(54) EARPHONE AND SET OF EARPHONES

(71) Applicant: Merry Electronics(Shenzhen) Co., Ltd., ShenZhen (CN)

(72) Inventors: Yen Ta Chiang, Taichung (TW); Hung-Chi Lin, Taichung (TW); Chao-Sen Chang, Taichung (TW)

(73) Assignee: Merry Electronics(Shenzhen) Co., Ltd., ShenZhen (CN)

( * ) Notice: Subject to any disclaimer, the term of this patent is extended or adjusted under 35 U.S.C. 154(b) by 0 days.

(21) Appl. No.: 16/831,829

(22) Filed: Mar. 27, 2020

(30) Foreign Application Priority Data

Jan. 31, 2020 (TW) ..... 109103058

(51) Int. Cl.

| | |
|---|---|
| ***H04R 3/00*** | (2006.01) |
| ***G10L 21/0216*** | (2013.01) |
| ***H04R 1/10*** | (2006.01) |
| ***H04R 25/00*** | (2006.01) |
| ***H04R 1/04*** | (2006.01) |

(52) U.S. Cl.
CPC ..... *H04R 25/505* (2013.01); *H04R 1/04* (2013.01); *H04R 25/407* (2013.01); *H04R 25/609* (2019.05); *H04R 2410/01* (2013.01); *H04R 2410/05* (2013.01)

(58) Field of Classification Search
CPC ..... H04R 25/505; H04R 25/609; H04R 1/04; H04R 25/407; H04R 2410/01; H04R 2410/05; H04R 1/1083; H04R 3/005; H04R 2460/13; H04R 1/10–12; H04R 5/033; H04R 5/0335; H04R 2201/10–109; G10L 21/0216; G10L 2021/02166
See application file for complete search history.

(56) References Cited

U.S. PATENT DOCUMENTS

2012/0278070 A1* 11/2012 Herve ..... G10L 21/0208 704/226
2012/0288079 A1* 11/2012 Burnett ..... H04M 1/7253 379/202.01

OTHER PUBLICATIONS

Alaa Tharwat, "Independent component analysis: An introduction," Applied Computing and Informatics, Aug. 2018, pp. 1-15.

(Continued)

*Primary Examiner* — Mark Fischer
(74) *Attorney, Agent, or Firm* — JCIPRNET

(57) ABSTRACT

The invention provides an earphone and a set of earphones. The earphone includes a processing circuit and a filtering module. The processing circuit acquires a first speech signal and performs a pre-processing operation on the first speech signal to generate a second speech signal. The filtering module includes high-pass, low-pass, and band-pass filters. The processing circuit is further configured to: receive first, second, and third signals respectively from the high-pass, low-pass, and band-pass filters; perform a noise reduction operation on the second and third signals to generate a fourth signal; and perform a signal synthesis operation on the first and fourth signals to synthesize the first and fourth signals to form an output speech signal.

20 Claims, 4 Drawing Sheets

(56) References Cited

OTHER PUBLICATIONS

Renevey R. Vetter et al., "Single channel speech enhancement using principal component analysis and MDL subspace selection," In Proceedings of the 6th European Conference on Speech Communication and Technology (Eurospeech'99), vol. 5, Sep. 1999, pp. 1-4.

Kris Hermus et al., "A Review of Signal Subspace Speech Enhancement and Its Application to Noise Robust Speech," EURASIP Journal on Advances in Signal Processing, vol. 2007, Apr. 2006, pp. 1-15.

* cited by examiner

EARPHONE AND SET OF EARPHONES

CROSS-REFERENCE TO RELATED APPLICATION

This application claims the priority benefit of Taiwan application serial no. 109103058, filed on Jan. 31, 2020. The entirety of the above-mentioned patent application is hereby incorporated by reference herein and made a part of this specification.

BACKGROUND

Technical Field

The disclosure relates to a speech processing device, and more particularly, to an earphone and a set of earphones.

Description of Related Art

Along with technology development, it has become one of the most common behaviors for people to instruct a voice assistant of an intelligent device with earphones. However, receiving a user's voice merely with the microphone in earphones may affect the result of speech recognition due to the interference of environmental noise. To improve earphone's performance in speech recognition, companies have been dedicated to researching relevant techniques.

For example, a known technology utilizes an accelerometer signal to facilitate the technique of voice activity detection (VAD) to determine the demarcation between speech signals and noise signals in a microphone's time-domain signal, as illustrated in FIG. 1.

FIG. 1 shows that, after being processed by the technique mentioned above, a microphone's time-domain signal 110 (including a speech component 110*a* and a noise component 110*b*) can be distinguished into multiple sections of noise signal (such as a noise signal 112) and speech signal (such as a speech signal 114). However, it can be seen that each speech signal (such as the speech signal 114) still includes the noise component 110*b*. In other words, such practice cannot eliminate all the noise components.

In addition, there is another known technique which utilizes an accelerometer to receive a bone-conduction audio signal essentially without an environmental noise to insulate exterior noises. Then, by replacing the low-frequency part in the microphone signal with the bone-conduction audio signal, the low-frequency noise is thereby filtered and eliminated. However, since the sampling frequency of the accelerometer signal is lower, and the bone-conduction audio signal essentially lacks the resonance of oral and nasal cavities, the bone-conduction audio signal is muffled and blurred compared with a signal received by a microphone through air, which may lead to a synthesized speech signal with a worse tone quality.

Hence, it is an important issue for persons skilled in the art to design a technical solution which improves the quality of speech signals.

SUMMARY

Accordingly, the disclosure provides an earphone and a set of earphones, which can be used to solve the above technical issues.

The disclosure provides an earphone including a processing circuit and a filtering module. The processing circuit acquires a first speech signal from at least one microphone and performs a pre-processing operation on the first speech signal to generate a second speech signal. The filtering module includes a high-pass filter, a low-pass filter, and a band-pass filter, wherein the high-pass filter performs a high-pass filter operation on the second speech signal to generate a first signal, the low-pass filter performs a low-pass filter operation on the second speech signal to generate a second signal, and the band-pass filter receives a bone-conduction audio signal corresponding to the first speech signal from at least one accelerometer and performs a band-pass filter operation on the bone-conduction audio signal to generate a third signal. The processing circuit is further configured to: receive the first signal, the second signal, and the third signal respectively from the high-pass filter, the low-pass filter, and the band-pass filter; perform a noise reduction operation on the second signal and the third signal to generate a fourth signal; and perform a signal synthesis operation on the first signal and the fourth signal to synthesize the first signal and the fourth signal to form an output speech signal.

The disclosure provides a set of earphones, including a first earphone and a second earphone. The first earphone includes at least one first microphone. The second earphone includes at least one second microphone, a processing circuit, and a filtering module. The at least one second microphone and the at least one first microphone form a microphone array. The processing circuit acquires a first speech signal from the microphone array and performs a pre-processing operation on the first speech signal to generate a second speech signal. The filtering module includes a high-pass filter, a low-pass filter, and a band-pass filter, wherein the high-pass filter performs a high-pass filter operation on the second speech signal to generate a first signal, the low-pass filter performs a low-pass filter operation on the second speech signal to generate a second signal, and the band-pass filter receives a bone-conduction audio signal corresponding to the first speech signal from at least one accelerometer and performs a band-pass filter operation on the bone-conduction audio signal to generate a third signal. The processing circuit is further configured to: receive the first signal, the second signal, and the third signal respectively from the high-pass filter, the low-pass filter, and the band-pass filter; perform a noise reduction operation on the second signal and the third signal to generate a fourth signal; and perform a signal synthesis operation on the first signal and the fourth signal to synthesize the first signal and the fourth signal to form an output speech signal.

Based on the above, the earphone and the set of earphones of the disclosure may provide an output speech signal with a better tone quality, thereby facilitating the subsequent speech recognition operation.

The accompanying drawings are included to provide a further understanding of the disclosure and are incorporated in and constitute a part of this specification. The drawings illustrate embodiments of the disclosure and, together with the description, serve to explain the principles of the disclosure.

DESCRIPTION OF THE EMBODIMENTS

Figure 1:
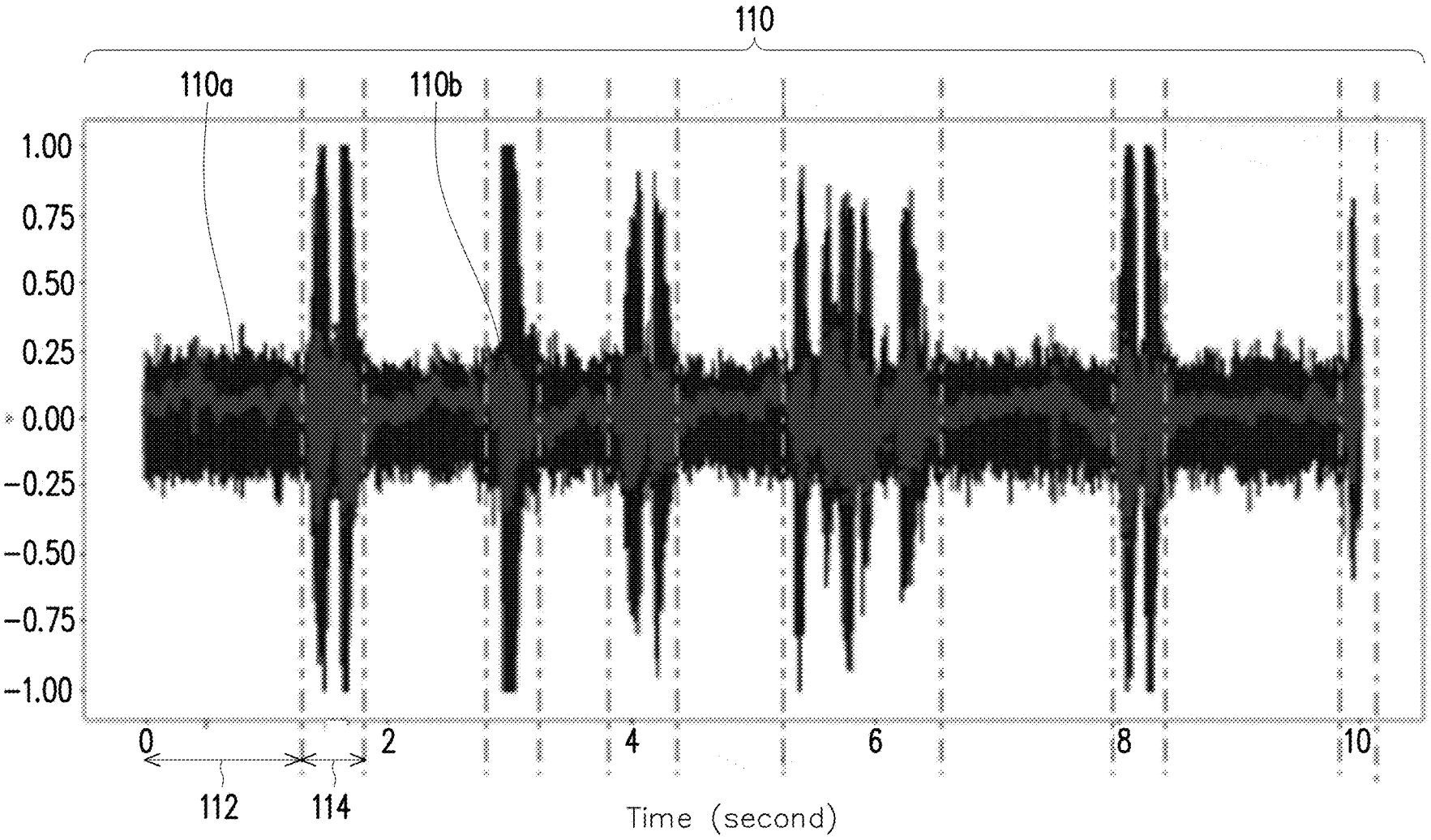
FIG. 1 is a schematic view of a known technique which combines an accelerometer signal and VAD technique to eliminate a noise.
Figure 2:
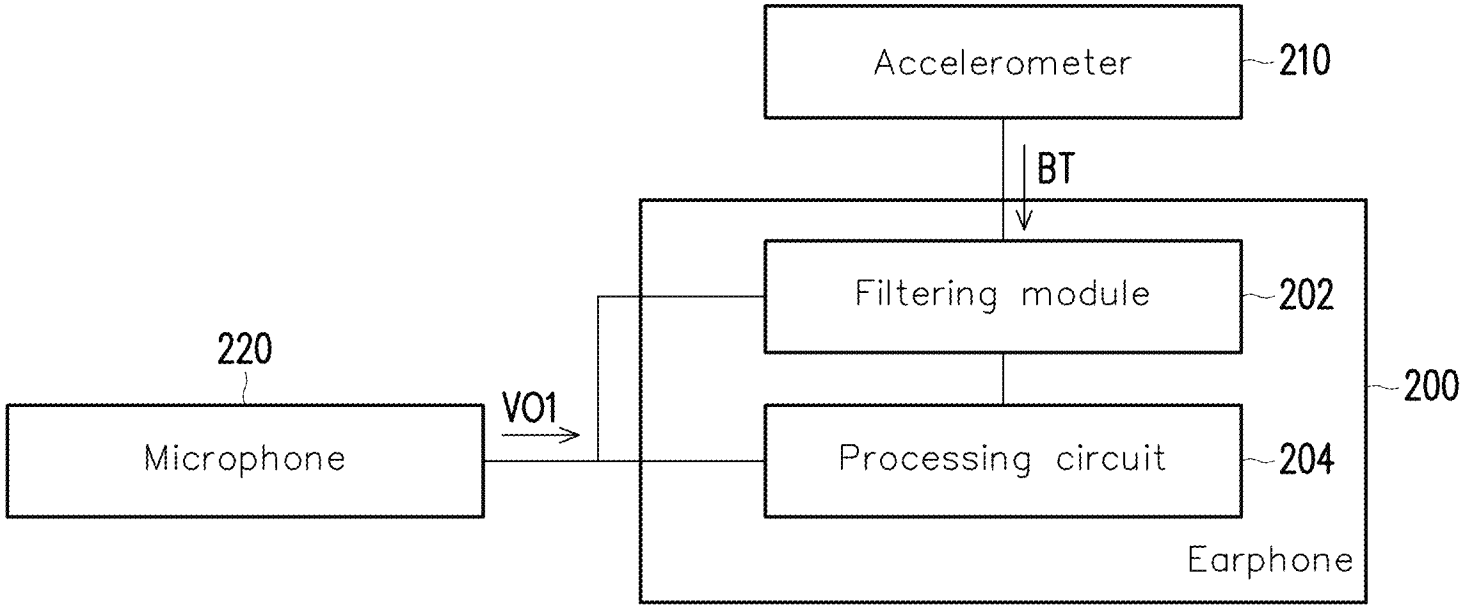
FIG. 2 is a schematic view of an earphone according to an embodiment of the disclosure.

Please refer to FIG. 2, which is a schematic view of an earphone according to an embodiment of the disclosure. As shown in FIG. 2, an earphone 200, for example, is an in-ear earphone and may include a filtering module 202 and a processing circuit 204, wherein the filtering module 202 may receive a bone-conduction audio signal BT from an accelerometer 210, and the filtering module 202 and the processing circuit 204 may receive a first speech signal VO1 from a microphone 220.

As shown in FIG. 2, the accelerometer 210 and the microphone 220 may be provided on the outside of the earphone 200. For example, the accelerometer 210 and the microphone 220 may be provided in another earphone which belongs to the same wired/wireless set of earphones including the earphone 200. In this case, the another earphone may transmit the bone-conduction audio signal BT, the first speech signal VO1, and other signals to the earphone 200 via relevant wired/wireless protocol, but the disclosure is not limited thereto.

In addition, in some embodiments, the accelerometer 210 and the microphone 220 may also be provided in the earphone 200 and coupled with the filtering module 202 and the processing circuit 204, as illustrated in FIG. 2. Also, in different embodiments, the microphone 220 may include a single microphone or a microphone array formed by multiple microphone units.

In the embodiment of the disclosure, the first speech signal VO1 may correspond to the bone-conduction audio signal BT. Specifically, in an embodiment, if a user who wears the above earphone or the set of earphones makes/generates a human speech signal by talking and other ways, the microphone 220 may convert the human speech signal into the first speech signal VO1 after receiving the above human speech signal. Meanwhile, the accelerometer 210 may capture the bone-conduction audio signal BT generated by vibrations produced by talking in the process of generating the above human speech signal.

Based on the bone-conduction audio signal BT and the first speech signal VO1, the filtering module 202 and the processing circuit 204 in the earphone 200 of the disclosure may collaborate to carry out the technical solution brought forth by the disclosure, and thereby provide an output speech signal with a better tone quality. The relevant details are elaborated hereinafter.

In the embodiment of the disclosure, the processing circuit 204 coupled to the filtering module 202 may be, for example, a general purpose processor, a special purpose processor, a conventional processor, a digital signal processor, multiple microprocessors, one or multiple microprocessors combined with a digital signal processor core, a controller, a microcontroller, an application specific integrated circuit (ASIC), a field programmable gate array (FPGA), any other kinds of integrated circuit, a state machine, a processor based on an advanced RISC machine (ARM), and the like.

Figure 3:
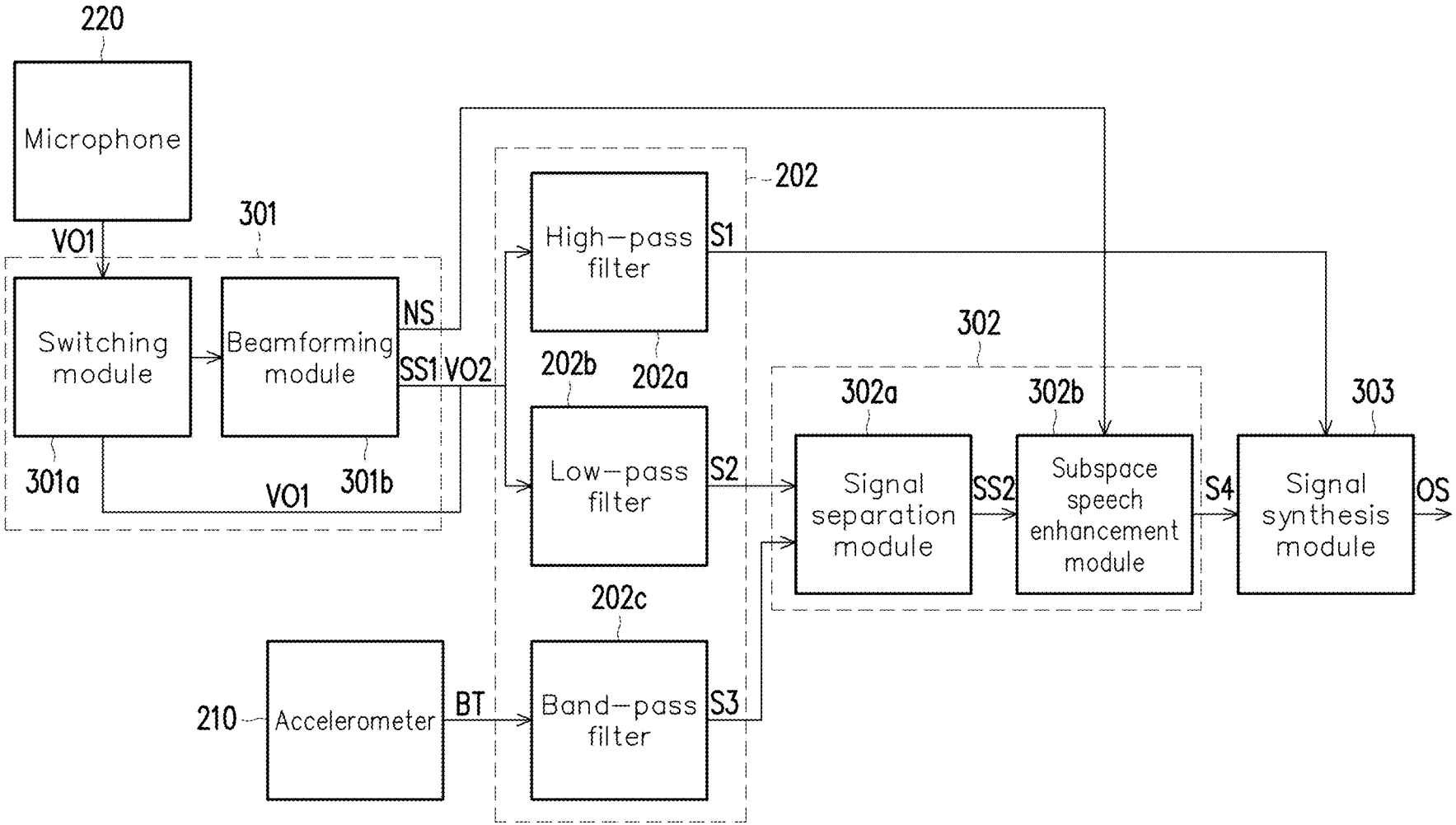
FIG. 3 is a schematic view of hardware and software modules within the earphone according to FIG. 2.

Please refer to FIG. 3, which is a schematic view of hardware and software modules within the earphone according to FIG. 2. In the embodiment of the disclosure, the filtering module 202 may include a high-pass filter 202*a*, a low-pass filter 202*b*, and a band-pass filter 202*c*. In addition, the processing circuit 204 may access the software module and program code required to realize the technical solution provided by the disclosure. To make the technique of the disclosure easier to be comprehended, it is assumed hereinafter that the software module accessed by the processing circuit 204 includes a pre-processing module 301, a noise reduction module 302, and a signal synthesis module 303, as shown in FIG. 3. It should be understood that the content shown by FIG. 3 is not the actual coupling relation between each software module stated above and the filtering module 202 but is merely to facilitate description of the signal transmission/processing mechanism of the disclosure.

As shown in FIG. 3, the processing circuit 204 may acquire the first speech signal VO1 from the microphone 220 and execute the pre-processing module 301 in order to perform a pre-processing operation on the first speech signal VO1 to generate a second speech signal VO2.

In the embodiment of the disclosure, the pre-processing module 301 for executing the pre-processing operation mentioned above may include a switching module 301*a* and a beamforming module 301*b*, wherein the switching module 301*a* may be used for determining whether the microphone 220 only includes a single microphone. If so, then the switching module 301*a* may output the first speech signal VO1 as the second speech signal VO2 to the high-pass filter 202*a* and the low-pass filter 202*b*.

In another embodiment, if the switching module 301*a* determines that the microphone 220 does not only include a single microphone (i.e., the microphone 220 includes a microphone array), then the processing circuit 204 may execute the beamforming module 301*b* in order to perform a beamforming operation on the first speech signal VO1 to generate a noise signal NS and a first specific signal SS1, wherein the first specific signal SS1 includes a first audio-signal component and a first noise component.

In an embodiment, the first specific signal SS1 is, for example, a part of a signal in the first speech signal VO1 corresponding to a sound source direction from which the first speech signal VO1 is generated, and the noise signal NS is, for example, the other part of the signal that does not correspond to the sound source direction mentioned above. From another viewpoint, the beamforming operation mentioned above may be understood as a noise canceling method in a physical space, but the disclosure is not limited thereto. After that, the beamforming module 301*b* may output the first specific signal SS1 as the second speech signal VO2 to the high-pass filter 202*a* and the low-pass filter 202*b*.

In short, if the microphone 220 only includes a single microphone, then the pre-processing module 301 outputs the first speech signal VO1 directly to the high-pass filter 202*a* and the low-pass filter 202*b*. Otherwise, if the microphone 220 is a microphone array, then the processing circuit 204 may output the first specific signal SS1 acquired from the beamforming operation to the high-pass filter 202*a* and the low-pass filter 202*b*.

After acquiring the second speech signal VO2, the high-pass filter 202*a* may perform the high-pass filter operation on the second speech signal VO2 to generate a first signal S1, and the low-pass filter 202*b* may perform the low-pass filter operation on the second speech signal VO2 to generate a second signal S2. In an embodiment, the crossover of the high-pass filter 202*a* and the low-pass filter 202*b* may fall between 1 kHz and 2 kHz. For example, if the crossover is set to be 1500 Hz, then the first signal S1 is, for example, the signal component in the second speech signal VO2 that is higher than 1500 Hz, and the second signal S2 is, for example, the signal component in the second speech signal VO2 that is lower than 1500 Hz.

In addition, after the accelerometer 210 acquires the bone-conduction audio signal BT, the band-pass filter 202*c* may perform the band-pass filter operation on the bone-conduction audio signal BT to generate a third signal S3. In an embodiment, the passband of the band-pass filter 202*c* may fall between 20 Hz and 1000 Hz, which is the frequency range of human speech signal in general.

After that, the processing circuit 204 may receive the first signal S1, the second signal S2, and the third signal S3 respectively from the high-pass filter 202*a*, the low-pass filter 202*b*, and the band-pass filter 202*c*. Further, the processing circuit 204 may execute the noise reduction module 302 to perform the noise reduction operation on the second signal S2 and the third signal S3 to generate a fourth signal S4.

In an embodiment, the noise reduction module 302 may generate a second specific signal SS2 based on the second signal S2 and the third signal S3, wherein the second specific signal SS2 may include a second audio-signal component and a second noise component which are separated from each other. After that, the noise reduction module 302 may further acquire the second audio-signal component from the second specific signal SS2 as the fourth signal S4 according to the noise signal NS.

As shown in FIG. 3, the noise reduction module 302 may include a signal separation module 302*a* and a subspace speech enhancement module 302*b*, wherein the signal separation module 302*a* may perform a signal separation operation to generate the second specific signal SS2 based on the second signal S2 and the third signal S3, and the subspace speech enhancement module 302*b* may perform a subspace speech enhancement operation to acquire the second audio-signal component from the second specific signal SS2 as the fourth signal S4 according to the noise signal NS.

In an embodiment, the signal separation module 302*a* may generate the second specific signal SS2 based on a blind signal separation algorithm of an independent components analysis (ICA), or on a principal components analysis (PCA) algorithm, but the disclosure is not limited thereto. For details of ICA mentioned above, please refer to Alaa Tharwat, *Independent component analysis: An introduction, Applied Computing and Informatics,* 2018. For the details of PCA, please refer to Renevey R. Vetter, N. Virag and J. Vesin, "Single channel speech enhancement using principal component analysis and MDL subspace selection," in *Proceedings of the 6th European Conference on Speech Communication and Technology* (EUROSPEECH '99), 1999, vol. 5, pp. 2411-2414. No further descriptions are provided herein.

In detail, since the signal separation module 302*a* performs the signal separation operation mentioned above based on the second signal S2 (which may be understood as a low-frequency component having a frequency lower than the crossover in the second speech signal VO2) and the third signal S3 (which is, for example, a low-frequency component having a frequency between 20 Hz and 1000 Hz in the bone-conduction audio signal BT), compared with a signal separation using only the second signal S2, a better performance in signal separation may be achieved. From another viewpoint, the signal separation operation mentioned above cannot be performed by using only the third signal S3. Hence, the disclosure provides an improvement of the signal separation performance by considering simultaneously the second signal S2 and the third signal S3 in performing the signal separation operation. From another viewpoint, the signal separation operation mentioned above may be understood as a noise canceling method in terms of statistical method.

After that, in the first embodiment, if the microphone 220 includes a microphone array, then the beamforming module 301*b* may provide correspondingly the noise signal NS to the subspace speech enhancement module 302*b*. In this case, the subspace speech enhancement module 302*b* may perform a subspace speech enhancement algorithm to acquire the second audio-signal component from the second specific signal SS2 according to the noise signal NS.

From another viewpoint, the subspace speech enhancement operation mentioned above may be understood as a noise canceling method in a vector space. Specifically, the subspace speech enhancement module 302*b* may eliminate a subspace including a noise in the second specific signal SS2 according to the noise signal NS in order to achieve the effect of eliminating an environmental noise while maintaining the second audio-signal component. For details of the subspace speech enhancement algorithm mentioned above, please refer to Kris Hermus, Patrick Wambacq, and Hugo Van hamme, "A Review of Signal Subspace Speech Enhancement and Its Application to Noise Robust Speech," *EURASIP Journal on Advances in Signal Processing,* 2006. No further descriptions are provided herein.

In addition, in the second embodiment, if the microphone 210 merely includes a single microphone, then the beamforming module 301*b* may not be able to provide the noise signal NS to the subspace speech enhancement module 302*b*. In this case, the subspace speech enhancement module 302*b* may still perform the subspace speech enhancement algorithm and directly acquire the second audio-signal component from the second specific signal SS2 as the fourth signal S4.

After that, the processing circuit 204 may execute the signal synthesis module 303 to perform the signal synthesis operation on the first signal S1 and the fourth signal S4 to synthesize the first signal S1 and the fourth signal S4 to form an output speech signal OS. In an embodiment, the cutoff frequency corresponding to the signal synthesis operation mentioned above may fall between 1 kHz and 2 kHz. In this way, the attenuation of a human speech signal having a frequency generally lower than 1 kHz caused by the signal synthesis operation mentioned above may be avoided.

Furthermore, since the signal separation module 302*a* performs the signal separation operation mentioned above based on the second signal S2 and the third signal S3, and the second signal S2 and the third signal S3 may be understood to be corresponding to the low-frequency component of the human speech signal generated by a user, the operations performed by the signal separation module 302*a* and the subspace speech enhancement module 302*b* may achieve a better noise canceling effect in the low-frequency signal of the human speech signal.

Hence, after the signal synthesis operation mentioned above is performed on the fourth signal S4 provided by the subspace speech enhancement module 302*b* and the first signal S1 (which corresponds to a high-frequency signal having a frequency higher than the crossover in the human speech signal generated by a user) provided by the high-pass filter 202*a*, the low-frequency signal of the output speech signal OS may have a lower noise signal. And since the high-frequency noise has a high directivity, it can be substantially filtered and eliminated via the beamforming module 301*b* without noise reduction by the noise reduction module 302. Therefore, the noise reduction module 302 only needs to perform the noise reduction operation in the low-frequency signal, which may boost effectively an operation speed and thereby facilitate the subsequent speech recognition operation.

Figure 4:
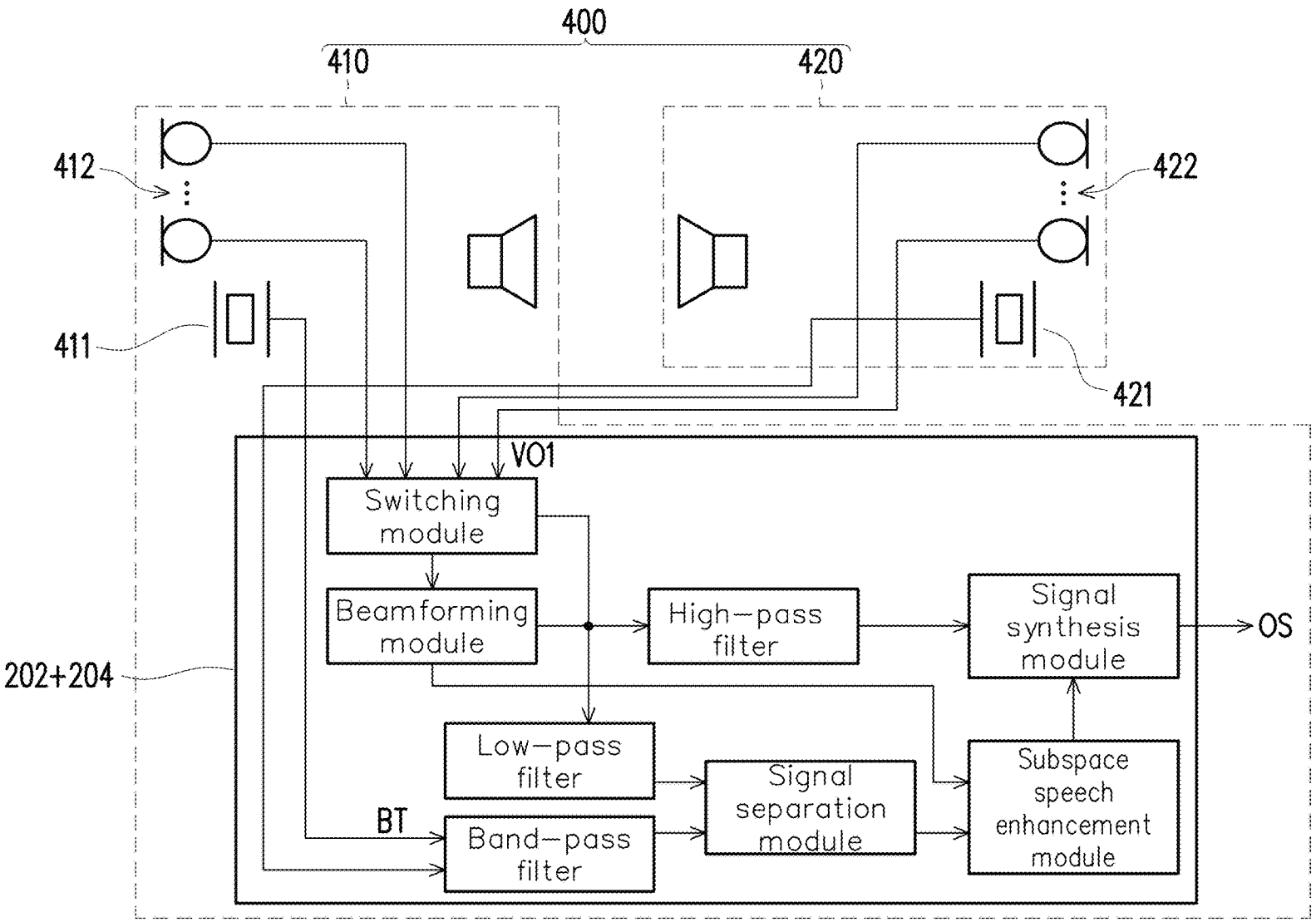
FIG. 4 is a schematic view of a set of earphones according to an embodiment of the disclosure.

Please refer to FIG. 4, which is a schematic view of a set of earphones according to an embodiment of the disclosure. As shown in FIG. 4, the set of earphones may include earphones 410 and 420, wherein the earphone 410 may include an accelerometer 411, a microphone 412, the filtering module 202, and the processing circuit 204, and the earphone 420 may include an accelerometer 421 and a microphone 422. It should be understood that, to facilitate understanding, the filtering module 202 and the processing circuit 204 in the earphone 410 of FIG. 4 are shown as the illustration of FIG. 3.

In the present embodiment, the microphones 412 and 422 may be coupled to the processing circuit 204. Since the microphones 412 and 422 may form a microphone array, after the processing circuit 204 receives the first speech signal VO1 from the microphone array, the processing circuit 204 may execute the switching module 301*a* to provide the first speech signal VO1 from the microphone array to the beamforming module 301*b* to perform the beamforming operation taught in the prior embodiments. In addition, after the band-pass filter 202*c* receives the bone-conduction audio signal BT from the accelerometers 411 and 421, the band-pass filter operation may be performed according to the content taught by the prior embodiments. After that, the filtering module 202 and the processing circuit 204 may perform relevant signal process according to the teachings of the prior embodiments, and further generate the output speech signal OS with a better tone quality. The details are not provided herein.

It should be understood that, although the microphones 412 and 422 only include a single microphone respectively, the microphones 411 and 421 may still be seen as a microphone array, and thus the beamforming module 301*b* may still perform the beamforming operation based on the first speech signal VO1.

In summary, different from the known method which replaces a low-frequency signal directly with a bone-conduction audio signal, the earphone of the disclosure makes the bone-conduction audio signal a reference when performing the signal separation operation to improve the performance in signal separation and thereby improve the effect in noise reduction. By doing so, the disclosure may provide an output speech signal with a better tone quality, and thereby facilitate the subsequent speech recognition operation.

Although the disclosure has been disclosed by the above embodiments, it will be apparent to one of ordinary skill in the art that modifications to the described embodiments may be made without departing from the spirit of the disclosure. Accordingly, the scope of the disclosure will be defined by the attached claims and their equivalents and not by the above detailed descriptions.

What is claimed is:

1. An earphone, comprising:

a processing circuit, acquiring a first speech signal from at least one microphone, and performing a pre-processing operation on the first speech signal to generate a second speech signal; and a filtering module, comprising a high-pass filter, a low-pass filter, and a band-pass filter, wherein the high-pass filter performs a high-pass filter operation on the second speech signal to generate a first signal, the low-pass filter performs a low-pass filter operation on the second speech signal to generate a second signal, and the band-pass filter receives a bone-conduction audio signal corresponding to the first speech signal from at least one accelerometer and performs a band-pass filter operation on the bone-conduction audio signal to generate a third signal, wherein the processing circuit is further configured to:

receive the first signal, the second signal, and the third signal respectively from the high-pass filter, the low-pass filter, and the band-pass filter;

perform a noise reduction operation on the second signal and the third signal to generate a fourth signal; and perform a signal synthesis operation on the first signal and the fourth signal to synthesize the first signal and the fourth signal to form an output speech signal.

2. The earphone according to claim 1, wherein the pre-processing operation performed by the processing circuit comprises:

outputting the first speech signal as the second speech signal to the high-pass filter and the low-pass filter in response to determining that the at least one microphone only comprises a single microphone.

3. The earphone according to claim 2, wherein in response to determining that the at least one microphone forms a microphone array, the processing circuit is further configured to:

perform a beamforming operation on the first speech signal to generate a noise signal and a first specific signal, wherein the first specific signal comprises a first audio-signal component and a first noise component; and output the first specific signal as the second speech signal to the high-pass filter and the low-pass filter.

4. The earphone according to claim 3, wherein the noise reduction operation comprises:

generating a second specific signal based on the second signal and the third signal, wherein the second specific signal comprises a second audio-signal component and a second noise component; and acquiring the second audio-signal component as the fourth signal from the second specific signal according to the noise signal.

5. The earphone according to claim 4, wherein the processing circuit performs a subspace speech enhancement algorithm to acquire the second audio-signal component from the second specific signal according to the noise signal.

6. The earphone according to claim 1, wherein the noise reduction operation comprises:

generating a second specific signal based on the second signal and the third signal, wherein the second specific signal comprises a second audio-signal component and a second noise component; and acquiring the second audio-signal component as the fourth signal from the second specific signal.

7. The earphone according to claim 6, wherein the processing circuit generates the second specific signal based on a blind signal separation algorithm of an independent components analysis or on a principal components analysis algorithm.

8. The earphone according to claim 1, wherein a crossover of the high-pass filter and the low-pass filter falls between 1 kHz and 2 kHz.

9. The earphone according to claim 1, wherein a passband of the band-pass filter falls between 20 Hz and 1000 Hz.

10. The earphone according to claim 1, further comprising the at least one microphone and the at least one accelerometer.

11. The earphone according to claim 1, wherein the earphone is an in-ear earphone.

12. The earphone according to claim 1, wherein a cutoff frequency corresponding to the signal synthesis operation falls between 1 kHz and 2 kHz.

13. A set of earphones, comprising:

a first earphone, comprising at least one first microphone; and a second earphone, comprising:

at least one second microphone, forming a microphone array with the at least one first microphone;

a processing circuit, acquiring a first speech signal from the microphone array, and performing a pre-processing operation on the first speech signal to generate a second speech signal; and a filtering module, comprising a high-pass filter, a low-pass filter, and a band-pass filter, wherein the high-pass filter performs a high-pass filter operation on the second speech signal to generate a first signal, the low-pass filter performs a low-pass filter operation on the second speech signal to generate a second signal, and the band-pass filter receives a bone-conduction audio signal corresponding to the first speech signal from at least one accelerometer and performs a band-pass filter operation on the bone-conduction audio signal to generate a third signal, wherein the processing circuit is further configured to:

receive the first signal, the second signal, and the third signal respectively from the high-pass filter, the low-pass filter, and the band-pass filter;

perform a noise reduction operation on the second signal and the third signal to generate a fourth signal; and perform a signal synthesis operation on the first signal and the fourth signal to synthesize the first signal and the fourth signal to form an output speech signal.

14. The set of earphones according to claim 13, wherein the pre-processing operation performed by the processing circuit comprises:

performing a beamforming operation on the first speech signal in correspondence to the microphone array to generate a noise signal and a first specific signal, wherein the first specific signal comprises a first audio-signal component and a first noise component; and outputting the first specific signal as the second speech signal to the high-pass filter and the low-pass filter.

15. The set of earphones according to claim 14, wherein the noise reduction operation comprises:

generating a second specific signal based on the second signal and the third signal, wherein the second specific signal comprises a second audio-signal component and a second noise component; and acquiring the second audio-signal component as the fourth signal from the second specific signal according to the noise signal.

16. The set of earphones according to claim 15, wherein the processing circuit acquires the second audio-signal component from the second specific signal according to the noise signal based on a subspace speech enhancement algorithm.

17. The set of earphones according to claim 15, wherein the processing circuit generates the second specific signal based on a blind signal separation algorithm of an independent components analysis or on a principal components analysis algorithm.

18. The set of earphones according to claim 13, wherein a crossover of the high-pass filter and the low-pass filter falls between 1 kHz and 2 kHz.

19. The set of earphones according to claim 13, wherein a passband of the band-pass filter falls between 20 Hz and 1000 Hz.

20. The set of earphones according to claim 13, wherein a cutoff frequency corresponding to the signal synthesis operation falls between 1 kHz and 2 kHz.

* * * * *